US006932614B1

(12) United States Patent
Kan

(10) Patent No.: US 6,932,614 B1
(45) Date of Patent: Aug. 23, 2005

(54) SOCKET WITH DOUBLE FUNCTIONS

(76) Inventor: Shin-Nan Kan, No. 209, Sec. 2, Chung Cheng Road, Hu Ko, Hsinchu Shien (TW)

( * ) Notice: Subject to any disclaimer, the term of this patent is extended or adjusted under 35 U.S.C. 154(b) by 0 days.

(21) Appl. No.: 10/822,740

(22) Filed: Apr. 13, 2004

(51) Int. Cl.[7] ..... H01R 90/05
(52) U.S. Cl. ..... 434/580; 439/581; 439/609
(58) Field of Search ..... 439/580, 581, 439/63, 607, 609

(56) References Cited

U.S. PATENT DOCUMENTS 4,593,464 A * 6/1986 Williams et al. ..... 29/879
4,605,269 A * 8/1986 Cohen et al. ..... 439/63
4,666,231 A * 5/1987 Sheesley et al. ..... 439/581
4,674,809 A * 6/1987 Hollyday et al. ..... 439/92
4,741,703 A * 5/1988 Johnescu et al. ..... 439/63
4,759,729 A * 7/1988 Kemppainen et al. ..... 439/580
4,799,902 A * 1/1989 Laudig et al. ..... 439/585
5,046,952 A * 9/1991 Cohen et al. ..... 439/63
5,516,307 A * 5/1996 Cartesse et al. ..... 439/581
5,676,565 A * 10/1997 Vagnoni ..... 439/580
5,759,069 A * 6/1998 Kitatani et al. ..... 439/675
5,913,698 A * 6/1999 Keng ..... 439/609
5,967,852 A * 10/1999 Follingstad et al. ..... 439/675
5,984,727 A * 11/1999 Wu et al. ..... 439/607
6,109,966 A * 8/2000 Chiou ..... 439/607
6,227,904 B1 * 5/2001 Wang et al. ..... 439/541.5
6,386,888 B1 * 5/2002 Skopic et al. ..... 439/63
6,447,311 B1 * 9/2002 Hu et al. ..... 439/108
6,575,786 B1 * 6/2003 Khemakhem et al. ..... 439/580
6,623,277 B1 * 9/2003 Zhu et al. ..... 439/63
6,663,397 B1 * 12/2003 Lin et al. ..... 439/63
6,676,443 B1 * 1/2004 Wang ..... 439/541.5
6,695,644 B2 * 2/2004 Zhao et al. ..... 439/580
6,824,403 B2 * 11/2004 Hall et al. ..... 439/108

* cited by examiner

*Primary Examiner*—Ross Gushi
(74) *Attorney, Agent, or Firm*—Rosenberg, Klein & Lee

(57) ABSTRACT

The invention relates to a socket with double functions, which includes a socket and a connecting cable, wherein the socket has a central hollow shaft for receiving a signal piece therein. A conductive frame is provided around the shaft and a cap being placed on front side of the socket. A connecting cable can insert into the socket to obtain electrical connection as well as signals transferring. So the communicating machine can be manufactured more conveniently and the volume can be efficiently decreased.

1 Claim, 3 Drawing Sheets

SOCKET WITH DOUBLE FUNCTIONS

FIELD OF THE INVENTION

The present invention relates to a socket for communicating machine, which owes double functions for connecting signals.

BACKGROUND OF THE INVENTION

Most communicating machines includes at least a socket for connecting with a signal cable to transfer the signals. Further, in order to obtain the power, a power supply socket is also necessary for connecting with a power plug. It can be found that the prior communicating machine is necessary to provide the said two sockets, which lead trouble in manufacturing and occupy a certain volume on the machine. Hence, the conventional communicating machine has a large volume, which is not easy to be decreased. It is inconvenient for carrying.

SUMMARY OF THE INVENTION

The present invention is to provide a socket with double functions including electrical connection and signal transferring. So, the volume of the communicating machine can be efficiently decreased. Now, accompanying with the following drawings, the character of the present invention will be described here and after.

DETAILED DESCRIPTION OF THE PREFERRED EMBODIMENT

Figure 1:
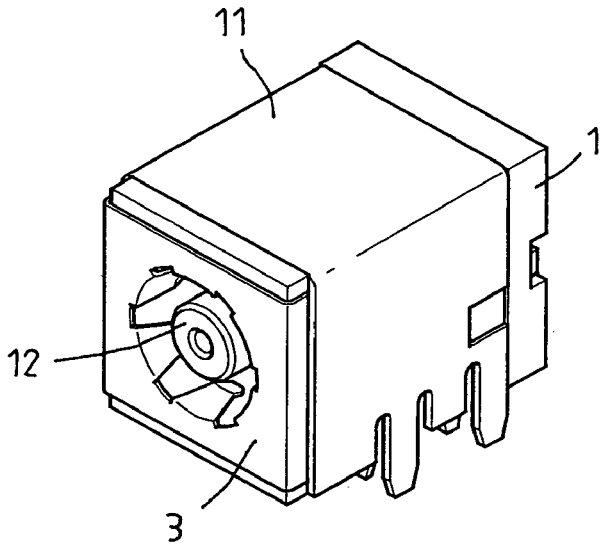
FIG. 1 is a perspective view showing a socket according to the present invention.
Figure 3:
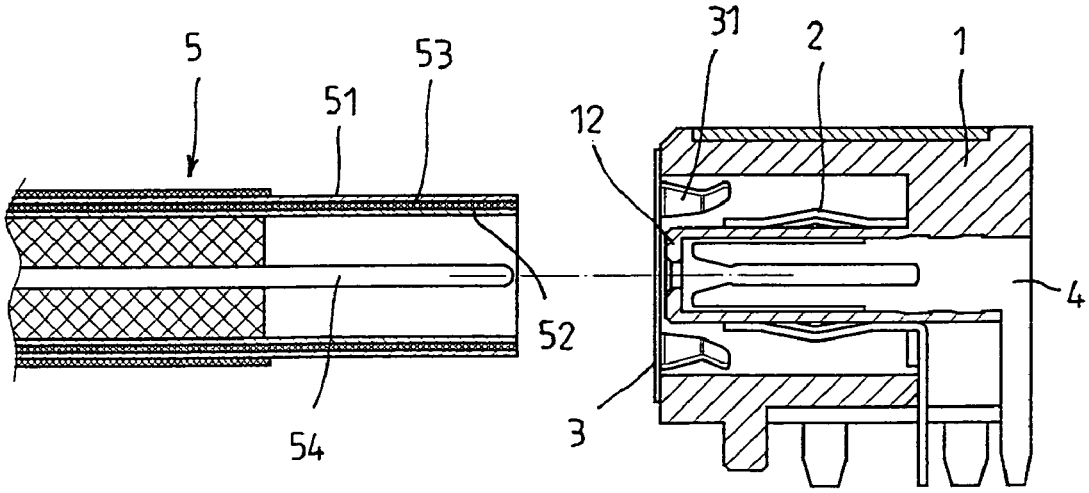
FIG. 3 is a cross-sectional plan view showing the socket and a connecting cable according to the present invention.
Figure 2:
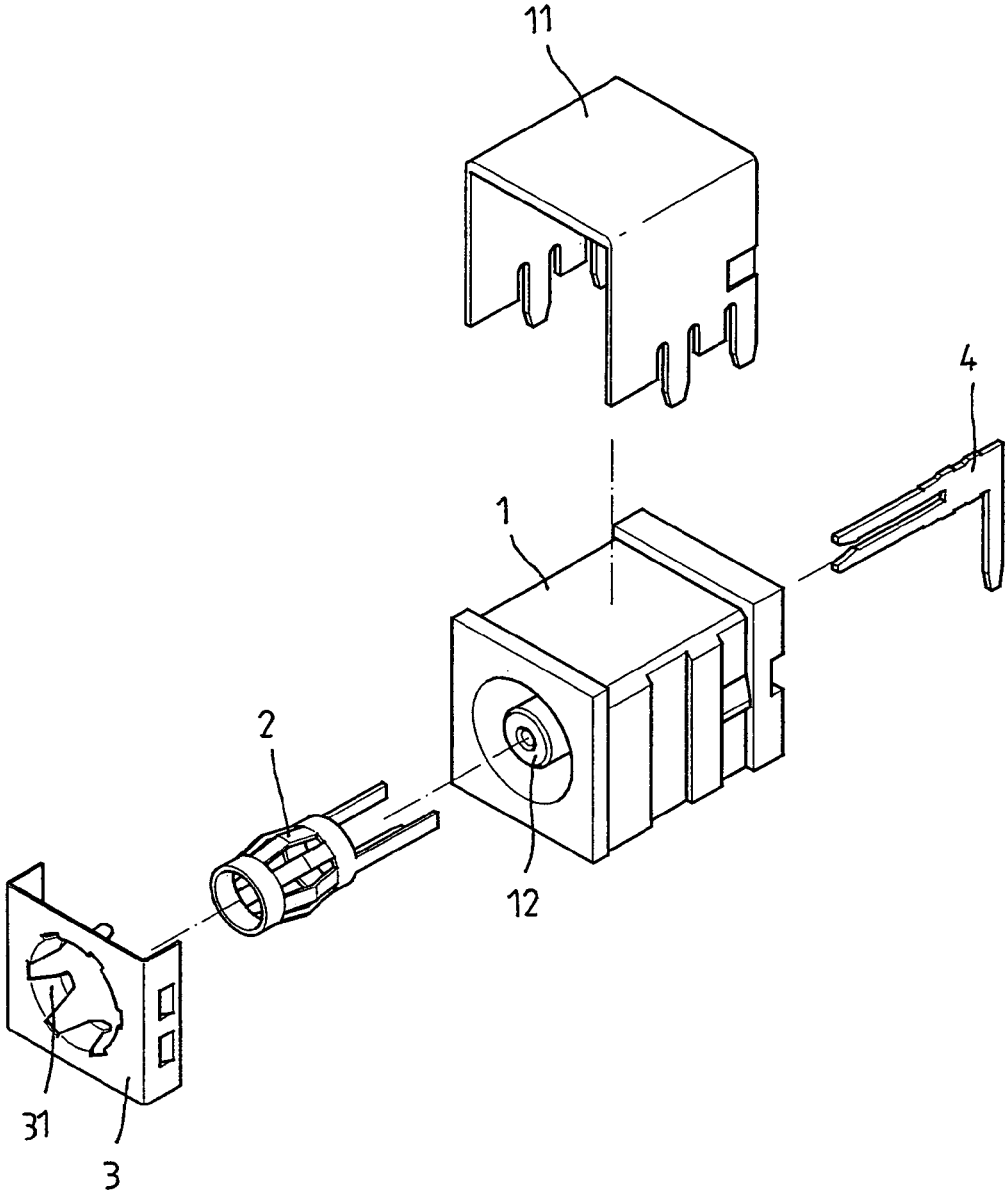
FIG. 2 is an exploded perspective view of FIG. 1.
Figure 4:
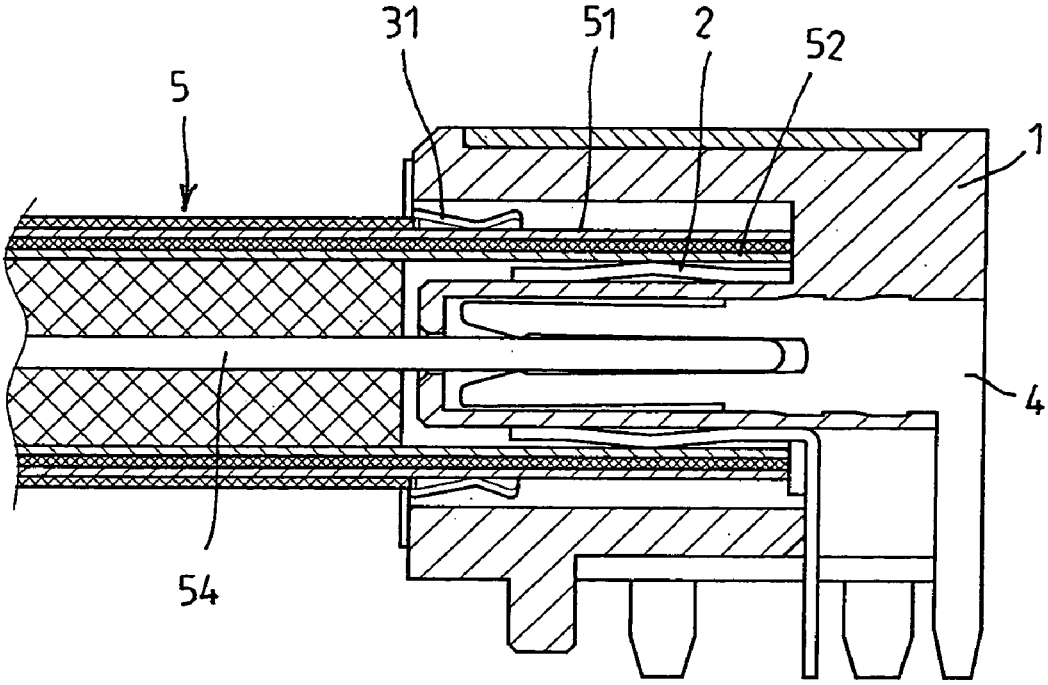
FIG. 4 is an assembled plan view of FIG. 3.

Please referring to FIGS. 1 and 2, it shows a socket (1) of the present invention, which includes a shell (11), a central hollow shaft (12). A conductive frame (2) is provided around the central shaft (12). A cap (3) is placed on front side of the socket (1), wherein the cap (1) has several inward elastic slices (31) toward front aperture of the socket (1). A signal-connecting piece (4) is inserted into the hollow shaft (12) of the socket (1).

A connecting cable (5) is formed with an outer metal layer (51) and an inner metal layer (52); both are separated by a middle non-conductive layer (53). A central signal wire (54) is provided as central axis of the cable (5).

When the cable (5) is inserted into the socket (1), the outer metal layer (51) contacts with the elastic slices (31) while the inner metal layer (52) contacts the conductive frame (2) that complete the electrical connection between the cable (5) and the socket (1). On other hand, the central signal wire (54) inserts into the shaft (12) and connects with the signal slice (4) that completes the signals transferring.

Accordingly, the socket of the present invention can provide double functions, signals transferring and electric connecting, by a single means that obtains the improvement of the invention.

I claim:

1. A socket with double functions including a socket and a connecting cable, wherein the socket has a central hollow shaft for receiving a signal piece therein, a conductive frame being provided around the shaft and a cap being placed on front side of the socket and being provided several inward elastic slices extending into front aperture of the socket; a connecting cable having an outer metal layer and an inner metal layer being separated by a non-conductive layer and having a central wire in axis for contacting the signal piece.

* * * * *